United States Patent [19]

Focke et al.

[11] 4,121,713

[45] Oct. 24, 1978

[54] PACK MADE FROM LAMINATED SHEETING

[75] Inventors: Heinz Focke; Kurt Liedtke, both of Verden, Fed. Rep. of Germany

[73] Assignee: Focke & Pfuhl, Verden, Fed. Rep. of Germany

[21] Appl. No.: 738,984

[22] Filed: Nov. 4, 1976

[51] Int. Cl.[2] ..... B65D 85/10

[52] U.S. Cl. ..... 206/274; 206/245; 206/484; 229/87 C

[58] Field of Search ..... 206/245, 484, 274, 273; 229/87 C; 428/513, 498, 462

[56] References Cited

U.S. PATENT DOCUMENTS

| | | | |
|---|---|---|---|
| 1,215,464 | 2/1917 | Armstrong | 206/274 |
| 1,525,619 | 2/1925 | Peterson | 229/87 C |
| 2,176,912 | 10/1939 | Luckett | 206/273 |
| 2,290,633 | 7/1942 | Cate | 428/498 |
| 2,300,224 | 10/1942 | Humphner | 428/498 |
| 3,265,287 | 8/1966 | Hovland | 206/245 |
| 3,333,683 | 8/1967 | Scharre | 229/87 C |
| 3,402,877 | 9/1968 | Pinkham | 206/273 |
| 3,928,693 | 12/1975 | Rudloff | 428/498 |

FOREIGN PATENT DOCUMENTS

| | | | |
|---|---|---|---|
| 2,252,059 | 10/1971 | Fed. Rep. of Germany | 206/245 |
| 1,446,539 | 6/1966 | France | 229/87 C |

*Primary Examiner*—William Price
*Assistant Examiner*—Joseph Man-Fu Moy
*Attorney, Agent, or Firm*—Sughrue, Rothwell, Mion, Zinn and Macpeak

[57] ABSTRACT

A parallelopiped-shaped package formed from a multilayer, laminated packaging foil having at least one layer of thermoplastic material. The closing flaps are constructed and arranged to be thermal welded together without the plasticized layer coming into contact with the bonding tool.

6 Claims, 8 Drawing Figures

Fig.3
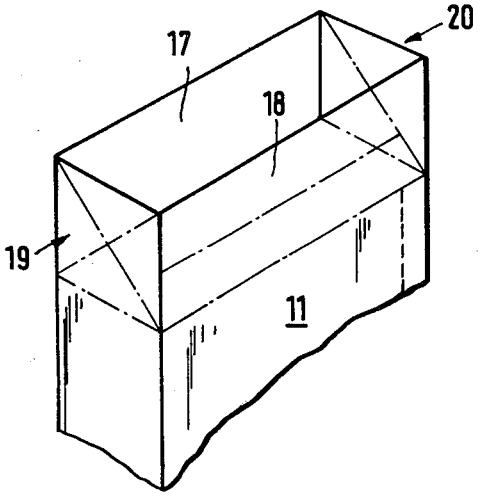
Fig.4
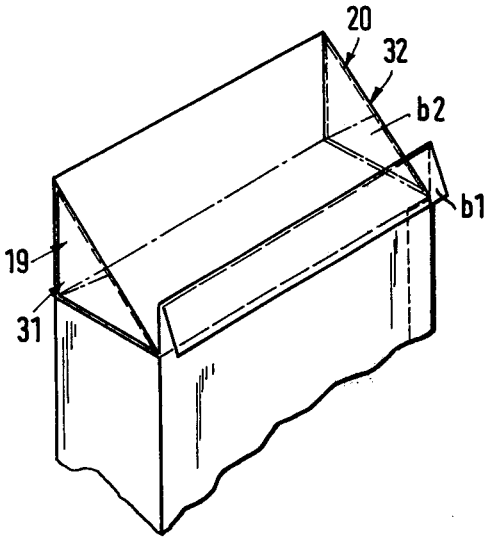
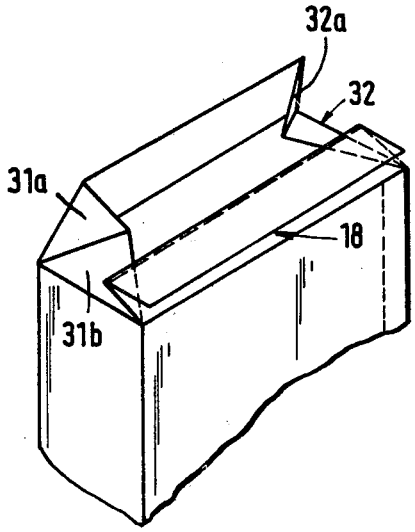
Fig.5
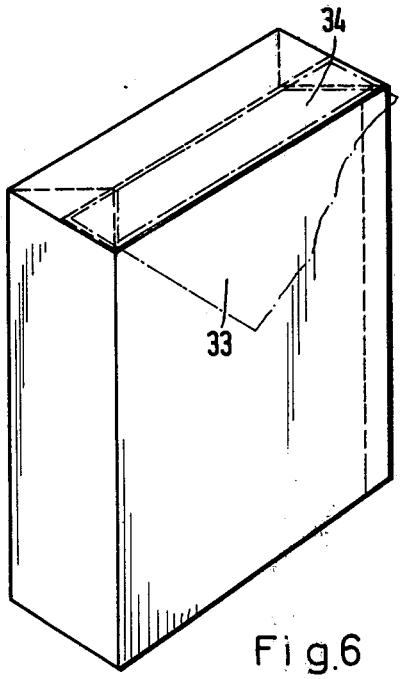
Fig.6

PACK MADE FROM LAMINATED SHEETING

BACKGROUND OF THE INVENTION

1. Field of the Invention

The present invention relates to a multilayer, laminated packaging foil or sheeting comprising at least one layer of thermoplastics material (laminated sheeting) and intended for use in blanks for producing packs which comprise parts (flaps) to be connected together by thermal bonding or welding. The invention also relates to a pack made of this laminated sheeting and to a device for closing a pack.

2. Description of the Prior Art

The advantage of laminated sheetings is that, because of the outer plastics layers, more particularly, polyethylene layers, there is no need to employ a separate adhesive for closing the packs in an aroma-tight manner. The foils, respectively, the overlapping closing flaps can be connected together by thermal bonding.

With the structure of the laminated sheeting, the bending tool is placed externally on the foil and which rests directly on the same thereby picking up residues as a result of the plasticized plastics layers. This produces sticking and smearing.

SUMMARY OF THE INVENTION

The object of the invention is to produce a novel multilayer packaging foil which obviates the above disadvantages. A further object of the invention is to produce a pack from the aforesaid foil in such a way that the closing flaps can be bonded or welded together without the bonding tools coming into contact with the plasticized layers.

The foil according to the invention for solving this problem is characterized in that at least the surface zones of the foil or blank facing towards a heated bonding tool have a higher fusion temperature than the temperature of the bonding tool.

Coatings having differing fusion points can be used. For example, the outer surface, i.e., that which faces towards the bonding tool can consist entirely or partially of a coating having a higher fusion point whereas the layer to be plasticized in order to bond the sections of the blank together, for example, a polyethylene layer, can have a lower fusion point than the bonding temperature of the bonding tool. Lacquer having a fusion temperature of 180°-200° C or a coating-free surface can form the outer coating. The bonding temperature for closing a pack produced from a foil of the aforementioned type will be in the range of 130° C.

The pack according to the invention, which is made from this type of laminated sheeting, more particularly, a cigarette pack, is so designed in the region of the closure flaps provided on the end sides thereof that the sides of the blank coated with plastics material having a lower fusion point, that is, the inner sides, are adjacent to one another so that the closure can be produced by the external application of heat. This is preferably achieved in that the inner closing flaps at the ends of the pack, that is, the longitudinal end flaps and the side end flaps, rest against the inner side of the outer flaps towards them through the intermediary of portions folded outwardly about 180°.

The end closure of the pack is produced by means of a support plate. This relatively thin support plate is inserted in the fold in the region of the adjacent outer sides of the laminated foil and it supports the end of the pack during the pressing together of the thermally bondable faces.

Other objects, features and advantages of the present invention will be made apparent in the course of the following detailed description of a preferred embodiment thereof which is provided with reference to the accompanying drawings.

BRIEF DESCRIPTION OF THE DRAWINGS

FIG. 3 is perspective view of the upper part of a pack made from a blank according to FIG. 1 in an intermediate position.

FIG. 4 is another intermediate position of the part of the pack according to FIG. 3.

FIG. 5 is a view according to FIGS. 3 and 4 of another intermediate position of the closing flaps on the ends of the pack.

FIG. 6 is a perspective view of a folded pack.

DESCRIPTION OF THE PREFERRED EMBODIMENTS

Figure 1:
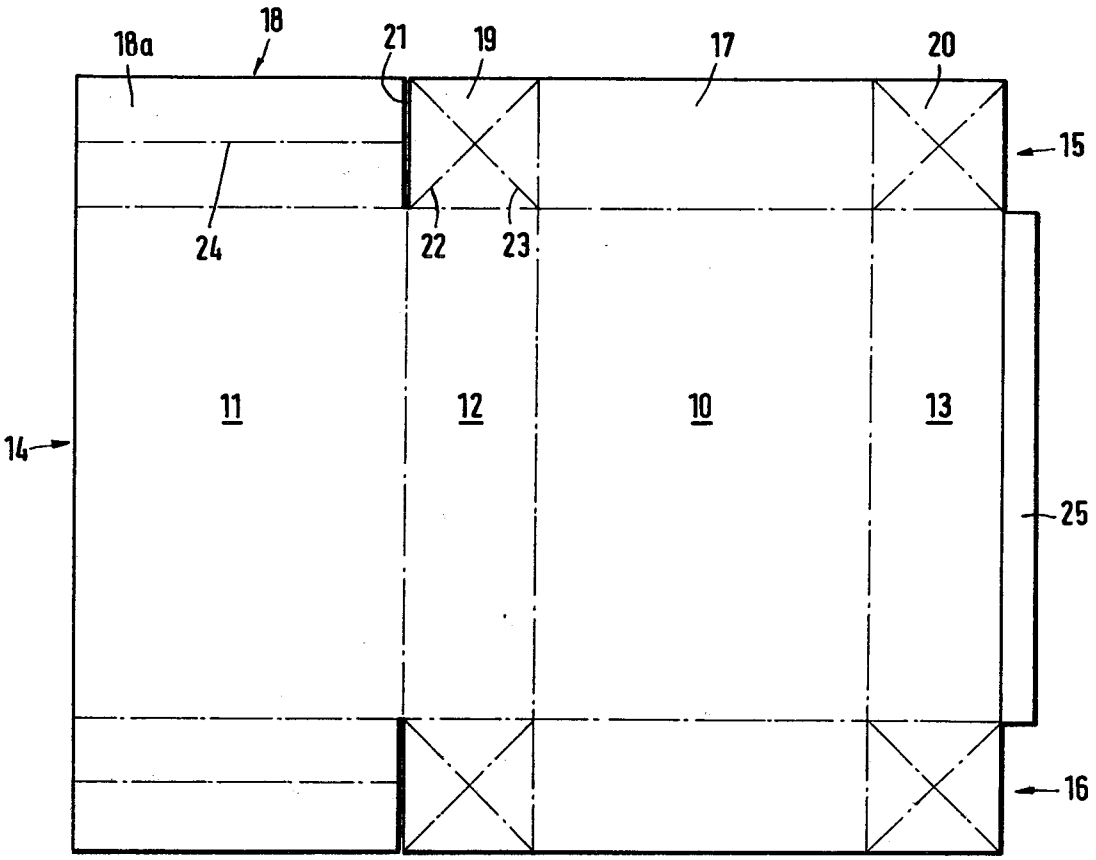
FIG. 1 shows a blank for producing a pack for holding cigarettes or the like in the extended state.

The blank shown in FIG. 1 is used to produce a parallelepipedal pack, more particularly, for cigarettes. The blank is divided by prescored linear markings into individual zones serving to form a front wall 10, a rear wall 11 and side walls 12 and 13. The aforementioned walls 10...13 which are arranged adjacent to one another in a row form a median blank strip 14. Side edge strips 15 and 16 which form the closing flaps on the end sides of the pack, are attached to the median strip 14.

In the present example the closing flaps consist of the longitudinal end flaps 17 and 18 which are of constant width and attached to the front wall 10 and the rear wall 11 and the side end flaps 19 and 20 which are formed in the region of the side walls 12 and 13. The side end flaps 19 and 20 are connected to the interposed longitudinal end flaps 17 which are externally disposed in the finished pack; the side end flaps 19 and the longitudinal end flaps 18, which are inwardly disposed in the finished pack, being separated from one another by a dividing cut 21.

The side end flaps 19 and 20 comprise prescored, intersecting diagonal fold lines 22 and 23 and the inner longitudinal end flaps 18 comprise a central fold line 24 extending over the entire length thereof.

The blank according to FIG. 1 consists of a sheeting having a special structure, more particularly, a so-called laminated sheeting.

Figure 2:
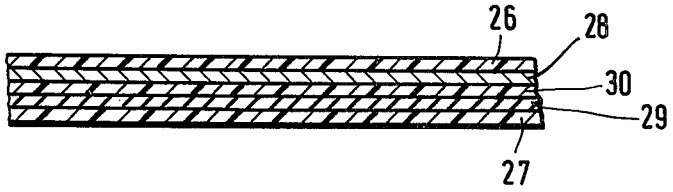
FIG. 2 is a cross-section of a conventional laminated sheeting or foil.
Figure 7:
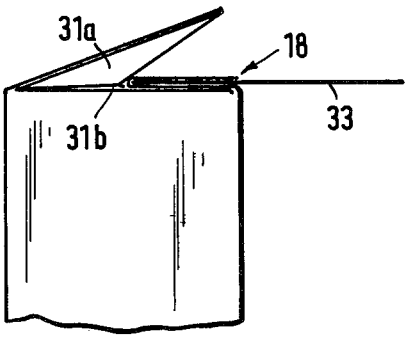
FIG. 7 is a side view of an intermediate position prior the fully folded position shown in FIG. 6 and includes the support plate.

The laminated foil according to the invention is shown in diagrammatic sectional form in FIG. 2. It is constructed to form the inner layer, more particularly, the side of the blank facing inwardly in the pack. The foil has a plastic layer 26 having a relatively low fusion point, for example, a polyethylene having a fusion point of 100°-110° C. At least one outer layer 27 consists of a coating having a higher fusion point than the inner layer 26, for example, a lacquered cellopane or a lacquer layer. Commercially available sealing lacquer having a fusion point of 180–200° C can be used for the outer layer 27. Otherwise the structure of the laminated sheeting is conventional, namely an inner aluminum foil ply 28, a paper layer 29 and an intermediate adhesive polyethylene layer 30.

Alternatively, the blank according to FIG. 1 can be so constructed that the median strip 14 comprises a different coating structure than the edge strips 15 and 16. The structure of the blank is preferably such that the median strip 14 comprises a conventional laminated sheeting structure whereas the outer layers 27, 29 and 30 have been omitted in the region of the edge strips 15 and 16 so that only the aluminum foil comprising a plastics layer on its inner side is present in this region.

Sheetings of the above-defined type can be continuously manufactured in the form of continuous webs, namely with continuous median strips 14 and edge strips 15 and 16.

A pack as shown in FIGS. 3-8 can be produced from the above-defined sheeting, respectively, entirely from a blank according to FIG. 1.

The blank is first folded about the pack contents, namely a group of cigarettes, in a tubular manner, the tubular flap 25 which is provided, for example, with a "hotmelt" being connected to the inner side of the rear wall 11.

In the embodiment according to FIGS. 3-7 the inner longitudinal end flap 18 is then folded about the central fold line 24 such that the original internal side of the longitudinal end flap 18 with the half 18*a* facing toward the free edge is outwardly or—after the longitudinal end flap 18 has been folded against the pack contents—upwardly disposed.

The free side end flaps 19 and 20 disposed opposite the longitudinal end flaps 18 are folded outwards about the diagonal fold line 22 in such a way that the trianglular flaps 31 and 32 in the intermediate position according to FIG. 4 end up with their original internal sides turned outwards. Thereafter the double-layer triangular side end flaps 19 and 20 are folded inwards about the diagonal fold lines 23 so that the original internal sides of the triangular tabs 31 and 32 are folded on top of one another. The triangular flaps 31 and 32 are ultimately so folded inwardly that the original side end flaps are superposed on one another in four layers. However, it is important that triangular inner faces 31*a*, 31*b* and 32*a*, 32*b* formed by the outwardly folded triangular tabs 31 and 32 in an intermediate position are folded against one another. These adjacent inner faces which are bonded together bear the fusible coating.

The above-described folding operation is carried out simultaneously in synchronism with the operation of folding the outer longitudinal end flap 17 against the pack contents and the operation of folding inwards the double-layer inner longitudinal end flap 18. In the embodiment according to FIGS. 3–7 the flap is folded laterally inwards between the side end flaps 19 and 20, respectively, the inner faces 31*a*, 31*b*; 32*a*, 32*b*.

Heat and pressure are now applied to the closed end face of the pack, for example, by means of an externally applied heated die (not shown). A seal-tight closure is produced by plasticizing together the mating sides of the longitudinal end flaps 17 and 18, that is the half 18*a* of the longitudinal end flap 18 with the inner side of the longitudinal end flap 17 and the side end flaps.

Figure 8:
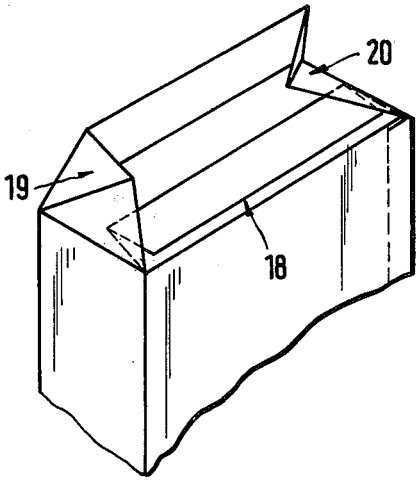
FIG. 8 is a view according to FIG. 5 showing an alternative method of folding the pack according to FIGS. 3–7.

In the variant shown in FIG. 8 the folding sequence differs in that after the intermediate folding position shown in FIG. 4 the inner longitudinal end flap 18 is then folded in a double layer against the pack contents. The side end flaps 19 and 20 together with the outer longitudinal end flap 17 are then folded over. The half 18*a* of the longitudinal end flap 18 participating in the bonding operation is thus adjacent to the side end flaps 19 and 20 in the end zones and also to the covering half of the inner side of the outer longitudinal end flap 17.

A support plate 33 can be inserted in the fold, more particularly, in the folded inner longitudinal flap 18 to prevent the contents of the pack from being damaged by the application of pressure and heat when the closure is being produced. Accordingly, the support plate 33 is disposed exclusively on faces comprising coatings having a higher fusion point. The disposition of the support plate 33 used to absorb the pressing pressure is such that the parts to be bonded together, namely the upper half of the longitudinal end flap and the half of the longitudinal end flap 17 disposed thereon as well as the zones of the side end flaps 19 and 20 to be joined together extend between the support plate 33 and the externally applied die. The support plate 33 advantageously comprises a raised zone 34 to compensate the height differences resulting from differing numbers of layers. In the present embodiment the raised zone 34 is a trapezoidal zone disposed outside of the region of the inwardly folded side end flaps 19 and 20.

What is claimed is:

1. A parallelopiped-shaped package for contents such as cigarettes, comprising: a blank with thermally weldable compound foil in partial areas of said blank, said blank enclosing the contents of the package in a closed tubular manner, said thermally weldable foil of the blank being located exclusively on the inside of the blank, said blank having a top-side closing of the package formed on a top surface by end portions of said blank comprising inner and outer lengthwise end flaps and side end flaps that are folded into the plane of the top side, said inner lengthwise end flap folded against the contents of the package, said outer lengthwise end flap holohedrally overlapping the top surface of the package connected to said inner lengthwise end flap, and side flaps folded in under the outer lengthwise end flap, said inner lengthwise end flap, being folded upon itself to form a closing strip with said thermally weldable foil facing outwardly, and said outer lengthwise end flap folded downward against said closing strip and thereto by thermal welding.

2. The package as claimed in claim 1, wherein the closing strip formed by folding the inner lengthwise end flap in the middle corresponds to half its width.

3. The package as claimed in claim 2, wherein the inner lengthwise end flap is divided off from the adjoining side end flaps by lateral separating cuts.

4. The package as claimed in claim 1, wherein the side end flaps are folded in between the inner lengthwise end flap and the outer lengthwise end flap.

5. The package as claimed in claim 1, wherein the inner lengthwise end flap is folded in between two welded surfaces of the side end flaps.

6. A pack as claimed in claim 1 wherein the side end flaps each have triangular tabs adjacent to the inner lengthwise end flap.

* * * * *